US007066068B1

(12) United States Patent
Caldwell

(10) Patent No.: US 7,066,068 B1
(45) Date of Patent: Jun. 27, 2006

(54) TABLE SAW

(76) Inventor: Larry Caldwell, 12122 Hastings Green, Houston, TX (US) 77065-3851

( * ) Notice: Subject to any disclaimer, the term of this patent is extended or adjusted under 35 U.S.C. 154(b) by 28 days.

(21) Appl. No.: 10/938,026

(22) Filed: Sep. 10, 2004

(51) Int. Cl.
*B26D 7/06* (2006.01)

(52) U.S. Cl. ..... 83/435; 83/435.11; 83/437.1; 125/12; 125/13.01; 125/35

(58) Field of Classification Search ..... 83/435, 83/435.11, 435.27, 437.1, 474, 477.2; 125/12, 125/13.01, 16.01, 20, 21, 35
See application file for complete search history.

(56) References Cited

U.S. PATENT DOCUMENTS

| | | | | | |
|---|---|---|---|---|---|
| 121,105 | A | * | 11/1871 | Hughes | 83/435.27 |
| 2,890,693 | A | * | 6/1959 | Evans | 125/35 |
| 3,844,269 | A | * | 10/1974 | Rater | 125/13.01 |
| 4,055,160 | A | | 10/1977 | Wilson | 125/13 |
| 4,455,907 | A | | 6/1984 | Bassett | 84/438 |
| 4,516,612 | A | | 5/1985 | Wiley | 144/1 R |
| 4,516,712 | A | * | 5/1985 | Whalley | 225/96.5 |
| 4,976,251 | A | | 12/1990 | Smith | 125/13.01 |
| RE35,666 | E | * | 11/1997 | Smith | 125/13.01 |
| 6,119,676 | A | | 9/2000 | Greenland | 125/35 |
| 6,253,757 | B1 | | 7/2001 | Benson | 125/35 |
| 6,427,677 | B1 | | 8/2002 | O'Banion et al. | 125/23.02 |
| 2002/0050201 | A1 | | 5/2002 | Lane et al. | 83/477.2 |

* cited by examiner

*Primary Examiner*—Clark F. Dexter
(74) *Attorney, Agent, or Firm*—Kenneth H. Johnson

(57) ABSTRACT

A table saw having a frame to support a powered saw blade, a work surface moveably mounted on the frame, the work surface having at least two portions with a space therebetween to allow the saw blade to pass between the two portions. The work surface portions are joined by at least two drive dogs moveably seated in aligned brackets, thereby holding the two portions in fixed relationship when the work surface is both stationary and moving. A pin extends from each drive dog into a keyway mounted on the frame with a portion of the keyway adjacent to the saw blade extending away from the saw blade, whereby a drive dog approaching the saw blade is withdrawn from one of the pair of brackets and from the space between the two portions while the remaining drive dog or drive dogs continue to maintain the two portions in fixed relationship.

4 Claims, 4 Drawing Sheets

TABLE SAW

BACKGROUND OF THE INVENTION

Field of the Invention

The present invention relates to table saws. More particularly it relates to a table saw having a traversing work surface which carries a work piece to a powered saw blade.

SUMMARY OF THE INVENTION

The present table saw comprises a frame to support a powered saw blade, a work surface moveably mounted on said frame, said work surface having an upper and a lower surface and comprising two portions having a space there between to allow said saw blade to pass between the two portions as the work surface is moved laterally over the frame. At least two pairs of brackets are mounted on the lower surface of the work surface, such that one bracket of each pair is mounted on one of the portions of the work surface and aligned to receive a moveable drive dog to thereby hold the two portions of the work surface in fixed relationship, when the work surface is stationary and when it is moving laterally across the frame. Extending from each drive dog is a pin which is engaged in a keyway mounted on the frame. The keyway extending along the space between the two portions of the work surface. A portion of the keyway adjacent to the saw blade extends away from the saw blade whereby a drive dog approaching the saw blade is withdrawn from one of a pair of brackets and from the space between the two portions of the work surface to allow the work surface to move past the saw blade (and any blade guard) at the point where the withdrawn drive dog had previously engaged the two portions of the work surface. The remaining drive dog or dogs continue to maintain the two portions of the work surface in fixed relationship.

Preferably the two portions of the work surface are mirror images. Also, it is preferable that each portion of the work surface is moveably mounted on fixed paths, for example on rollers in slots or on rails on the frame. Thus the two portions can preferably only move laterally forward and backward.

DETAILED DESCRIPTION

In the following description, the keyway may also comprise a cam surface or surfaces against which the pin on the drive dog rides to move the drive dog in and out of engagement in the bracket on the opposite portion of the work surface. There must be at least two sets of brackets and a drive dog with a pin engaged in each, one positioned towards the first proximal end of the space and one toward the distal end of the space, such that one will always be engaged to keep the two portions moving in unison. There of course can be more than two sets of brackets and pins. In the embodiment illustrating the invention, both drive dogs disengage in one direction and both pins move in the same keyway. However, there may be more than one keyway and the drive dogs may engage and disengage from opposite portions of the work surface.

There may also be a reversal of parts from that illustrated, such as the manner in which the work surface is enabled to move laterally on the frame, may be wheels in slots on the frame or wheels on the frame in a slots on the portions of the lower surface of the work surface. And wheels are not necessary in any case.

Generally the table saw comprises a frame, a work surface moveably mounted on said frame, said work surface having an upper and a lower surface and comprising two portions having a space there between, a powered saw blade positioned in said space, at least two pairs of brackets mounted on the lower surface of the work surface, such that one bracket of each pair is mounted on one of the portions of the work surface, said pair being aligned to receive a moveable drive dog therein, a pin extending from each drive dog which is engaged in a keyway mount on the frame, the keyway extending along the space between the two portions of the work surface and having a portion of the keyway adjacent to the saw blade extending away from the saw blade whereby a drive dog approaching the saw blade is withdrawn from one of said aligned pair of brackets and from the space between the two portions of the work surface to allow the work surface to move past the saw blade at the point where the withdrawn drive dog had previously engaged the two portions of the work surface.

Figure 1:
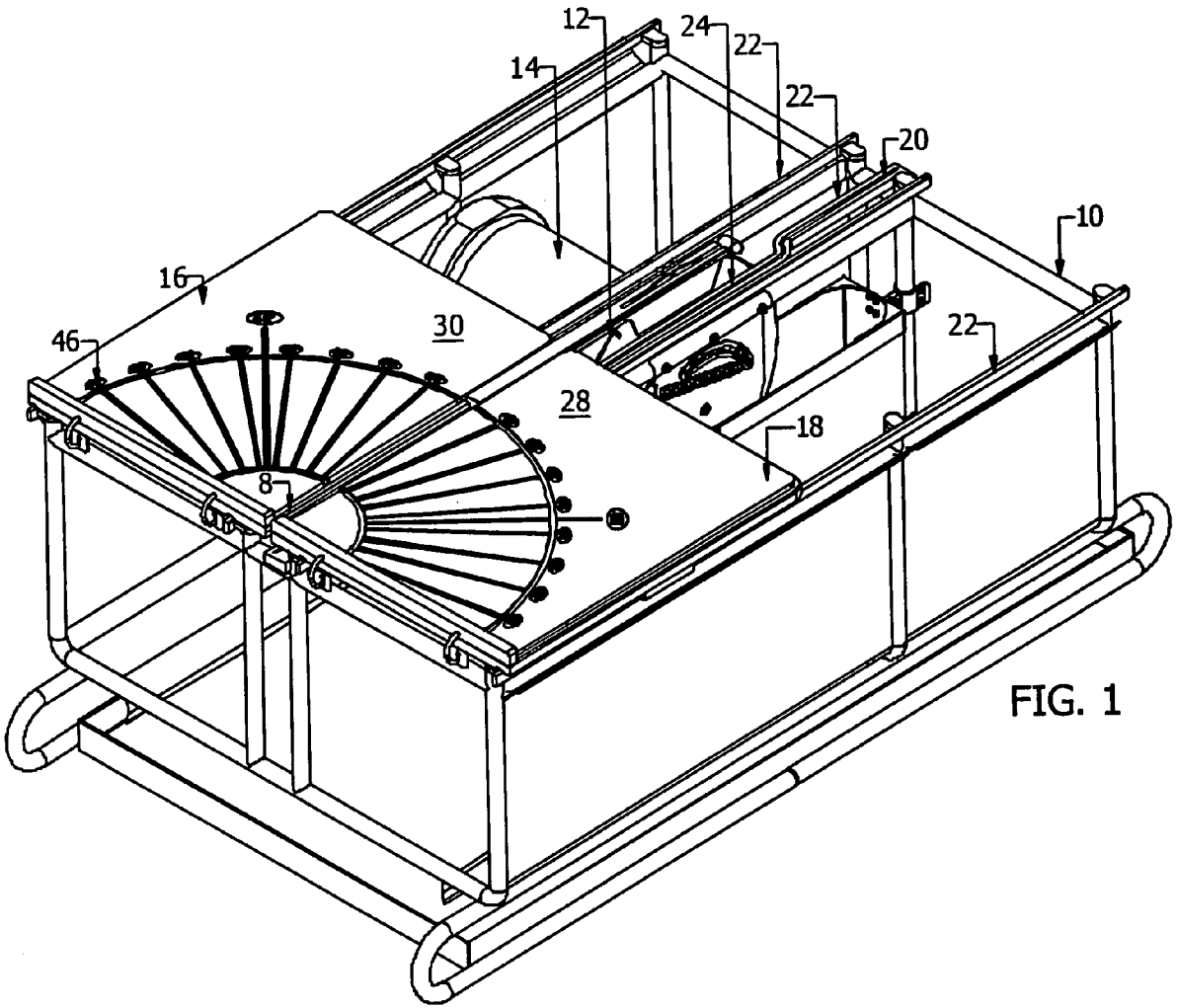
FIG. 1 is a isometric view of one embodiment of the present table saw.

Referring to FIG. 1, the overall table saw is shown in an isometric view. The frame is generally shown at 10 and provides a support for the essential elements of the apparatus, thus can have any number of possible configurations. The work surface 16/18 is comprised of two components 16 and 18 each having an upper surface 30 and 28 respectively.

The saw blade (and safety cover) 12 and electric motor 14 are located within its frame below the work surface 16/18, the blade being driven in this embodiment by direct mounting (not shown) on the shaft (not shown) of the electric motor. Also in this embodiment the two components of the work surface 16/18 are mirror images, each having indicia 46 thereon providing the angles marked in 10° units from the center of the work surface (approximately the center of space between the two components 16 and 18).

Figure 2:
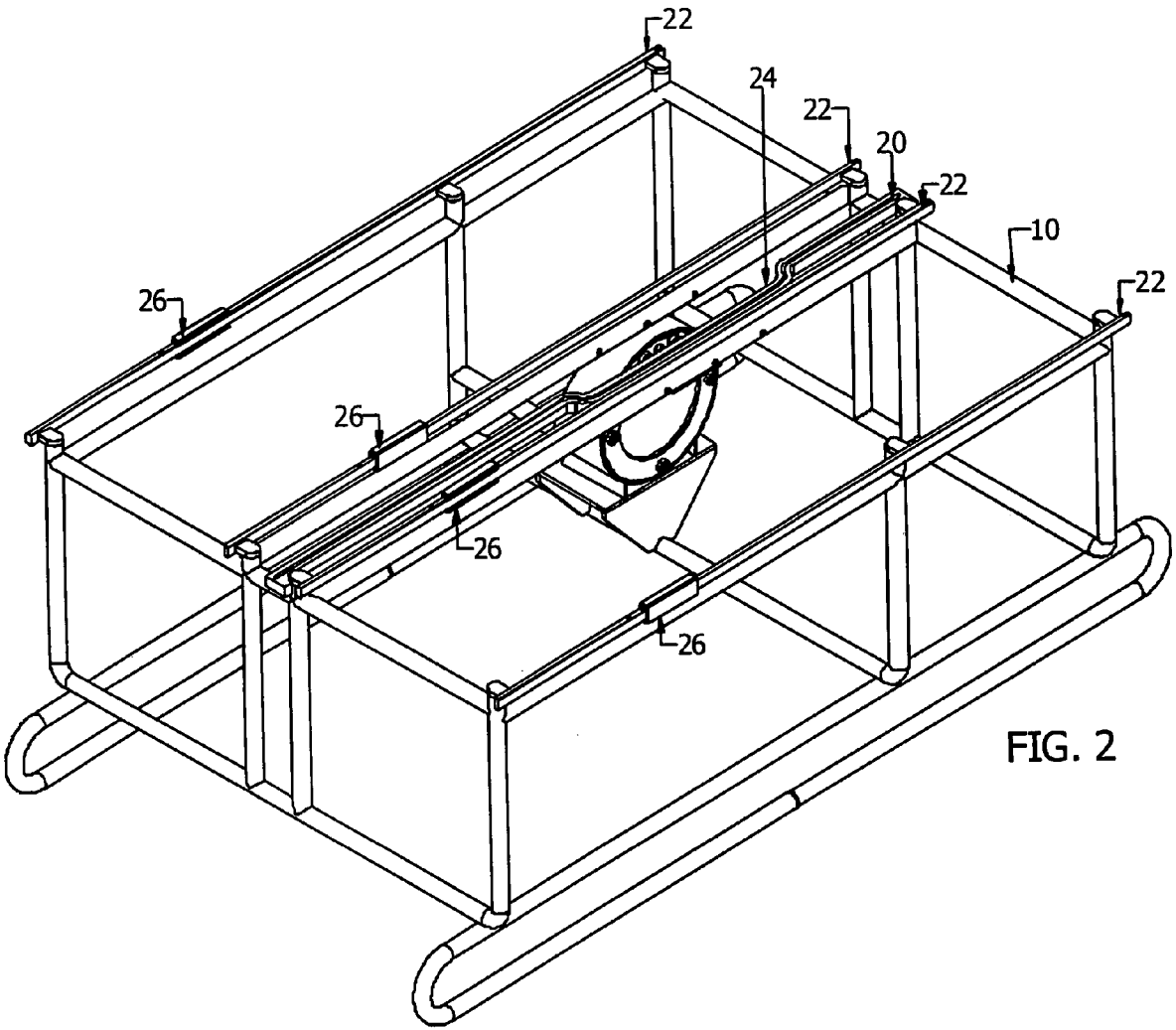
FIG. 2 is an enlarged isometric view of the embodiment of FIG. 1 having the traversing two parts removed to show the details of the keyway.

Each portion of the work surface 16 and 18 is mounted on a pair of guide rails 22 onto a guide roller assembly 26 (one on each guide rail) to allow the work surface components to traverse across the frame along the rails. These elements are seen in FIG. 2 from which the work surface components have been removed.

The guide rails and the size of work surface components 16 and 18 are adjusted to provide a space or gap 8 between the two components which will allow them to pass on either side of a saw blade protruding into space 8.

Figure 3:
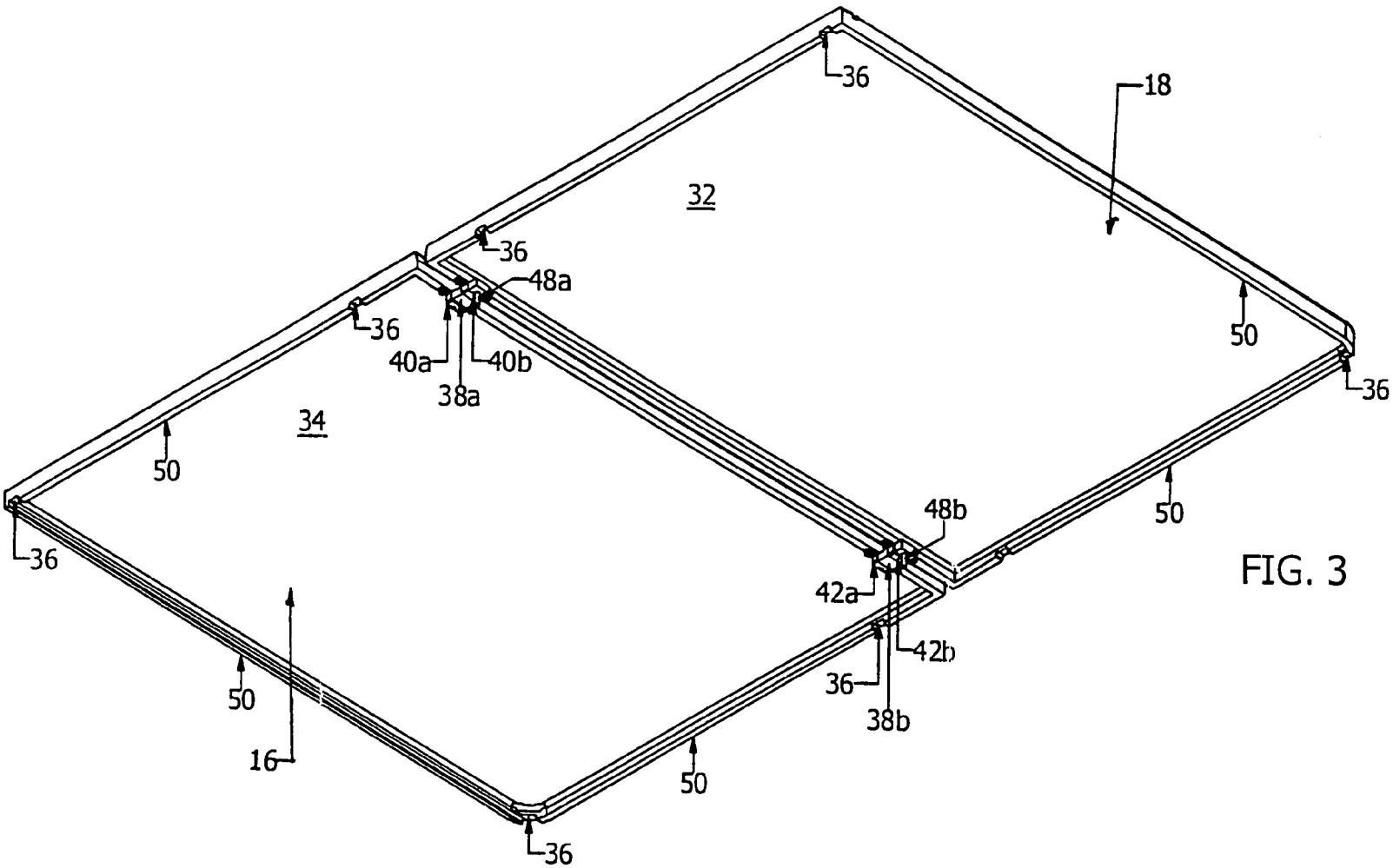
FIG. 3. is an isometric view of the lower surface of the work surface of the embodiment of FIG. 1.
Figure 4:
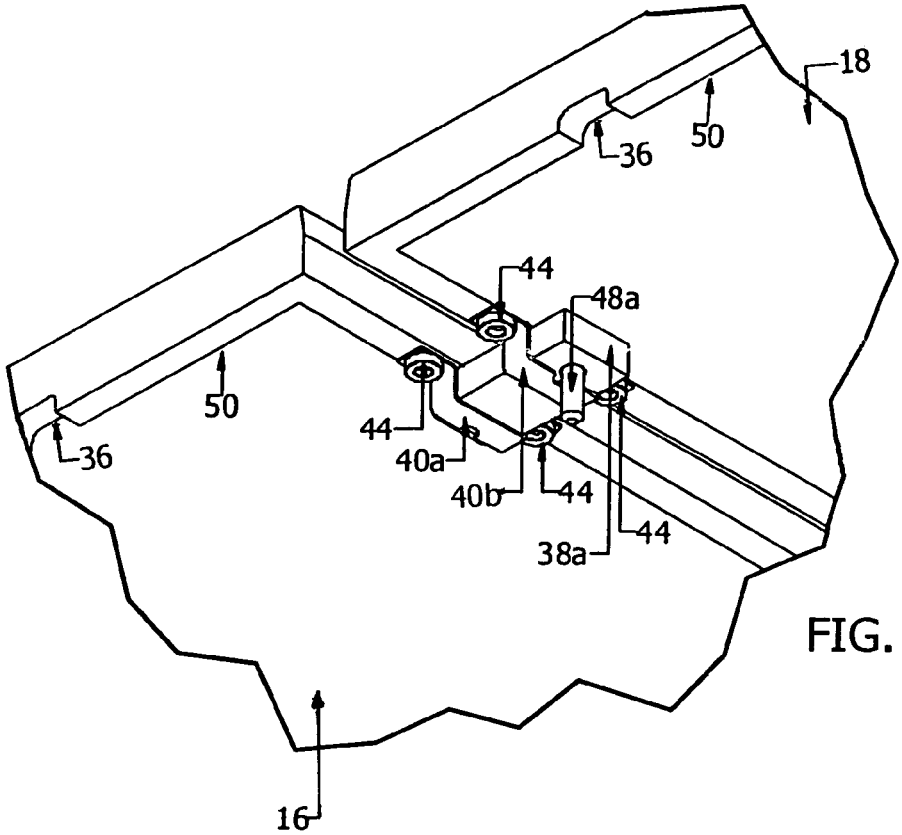
FIG. 4 is an isometric view of an enlarged detail of one of the dive dog/bracket combinations shown in FIG. 3.
Figure 5:
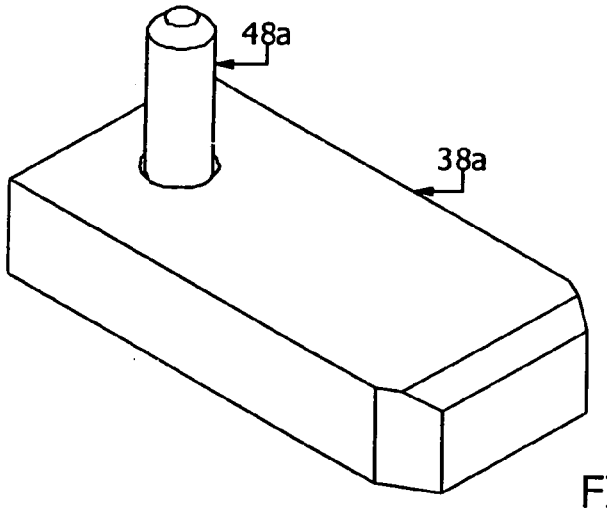
FIG. 5 is an enlargement of a drive dog.

Referring now to FIG. 3 the lower surfaces 34 and 32 of work surfaces 16 and 18 respectively are shown. In order for the work surface 16/18 to move as a unit, the two components are joined by drive dogs 38*a* and 38*b* which are slidably engaged through brackets 40*a* and 42*a*, and through 40*b* and 42*b*, respectively and wherein the brackets are attached by screws 44 to the lower surfaces of the work surface components. A cam follower pin 48*a* and 48*b* extend from each drive dog 38*a* and 38*b* respectively, such that when the work surface components 16/18 are seated on the guide rail assembly 26 on the guide rails 22, the cam follower pins extend into a keyway 20 and ride in the keyway as the work surface 16/18 traverses the frame effectively as one piece, held in alignment by the drive dogs. Notches 36 are provided on the lips 50 extending around the work surface components 16 and 18 respectively to allow work surface to slide on the rail and to be held in fixed lateral spacing.

When seated on the guide rails, the cam follower pins will seat in the keyway 20 and follow its configuration as the work surface traverses the frame. In the positioning of the work surface as shown in FIG. 1, both drive dogs are down site from the saw blade with drive dog 38*b* being closest to the saw blade. To process a material such as wood or tile through the saw, the work surface 16/18 slides on the guide rails and rail assemblies toward the saw as a single unit because the drive dogs hold the two portions of the work surface in alignment. As drive dog 38*b* approaches the saw blade, a portion 24 of the keyway 20 causes the drive dog 38*b* to withdraw from bracket 42*a* on the work surface 16 and from space 8, while the drive dog 38*a* continues to hold the two work surface components in alignment.

As the drive dog 38*b* passes by the saw blade, the configuration of keyway 20 returns the drive dog into the space 8 and bracket 42*a* for alignment. Similarly if drive dog 38*a* is carried to the area of the saw blade, it will be withdrawn from bracket 40*a* and space 8 while drive dog 38*b* maintains the alignment.

The present table saw is a multipurpose wet or dry saw particularly useful for tile cutting.

The invention claimed is:

1. A table saw comprising a frame, a work surface moveably mounted on said frame, said work surface having an upper and a lower surface and comprising two portions having a space therebetween, a powered saw blade aligned with and positionable in said space, at least two pairs of brackets mounted on the lower surface of the work surface such that one bracket of each pair is mounted on one of the portions of the work surface and the other bracket of each pair is mounted on the other one of the portions of the work surface, the brackets of each said pair being aligned and each said pair receiving a moveable drive dog therein, a pin extending from each drive dog and engaged in a keyway mounted on the frame, the keyway extending along the space between the two portions of the work surface, and a portion of the keyway adjacent to the saw blade extending away from the saw blade, whereby one of the drive dogs approaching the saw blade is withdrawn from one of the aligned pair of brackets and from the space between the two portions of the work surface to allow the work surface to move past the saw blade at the point where the withdrawn drive dog had previously engaged the two portions of the work surface.

2. The table saw according to claim 1 wherein the two portions of the work surface are mirror images.

3. The table saw according to claim 1 wherein each portion of the work surface is moveably mounted on fixed paths.

4. The table saw according to claim 1 wherein another one of the drive dogs continues to remain in place in its respective pair of aligned brackets.

* * * * *